US006468587B2

(12) United States Patent
Chang et al.

(10) Patent No.: US 6,468,587 B2
(45) Date of Patent: Oct. 22, 2002

(54) TREATMENT OF FIBROUS SUBSTRATES WITH ACIDIC SILSESQUIOXANES EMULSIONS

(75) Inventors: John C. Chang, New Brighton; Angela J. Nixon, Rosemount; Irvin F. Dunsmore, Ham Lake, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/878,479

(22) Filed: Jun. 11, 2001

(65) Prior Publication Data

US 2002/0025442 A1 Feb. 28, 2002

Related U.S. Application Data

(60) Provisional application No. 60/215,479, filed on Jun. 30, 2000.

(51) Int. Cl.[7] ..... B05D 3/04

(52) U.S. Cl. ..... 427/346; 427/377; 427/387; 427/389.9

(58) Field of Search ..... 427/387, 389.9, 427/365, 377, 346

(56) References Cited

U.S. PATENT DOCUMENTS

| | | | | |
|---|---|---|---|---|
| 3,493,424 | A | | 2/1970 | Mohrlok et al. |
| 3,620,823 | A | * | 11/1971 | Smith |
| 4,027,073 | A | * | 5/1977 | Clark |
| 4,351,736 | A | | 9/1982 | Steinberger et al. ..... 252/8.6 |
| 4,617,057 | A | * | 10/1986 | Plueddemann ..... 106/2 |
| 4,781,844 | A | | 11/1988 | Kortmann et al. ..... 252/8.6 |
| 5,073,442 | A | | 12/1991 | Knowlton et al. ..... 427/389 |
| 6,225,403 | B1 | | 5/2001 | Knowlton ..... 524/858 |

FOREIGN PATENT DOCUMENTS

| | | | |
|---|---|---|---|
| WO | WO 98/18855 | * | 5/1998 |

* cited by examiner

*Primary Examiner*—Erma Cameron
(74) *Attorney, Agent, or Firm*—Kent S. Kokko

(57) ABSTRACT

This invention relates to a method for imparting soil-resistant and water-repellent properties to fibrous polyamide substrates (such as carpet fibers) by applying an acidic aqueous treating solution containing a silsesquioxane. This invention also relates to the treating solution used to impart soil resistance, and water repellency to the fibrous polyamide. This invention also relates to treated fibrous substrate made according to the method of this invention.

13 Claims, No Drawings

TREATMENT OF FIBROUS SUBSTRATES WITH ACIDIC SILSESQUIOXANES EMULSIONS

CROSS REFERENCE TO RELATED APPLICATION

This application claims priority to U.S. Provisional Patent Application No. 60/215,479, filed Jun. 30, 2000.

FIELD OF THE INVENTION

This invention relates to a method for imparting soil-resistant and water-repellent properties to fibrous polyamide substrates (such as carpet fibers) by applying an acidic aqueous treating solution containing a silsesquioxane. This invention also relates to the treating solution used to impart soil resistance, and water repellency to the fibrous substrate. This invention also relates to treated fibrous substrate made according to the method of this invention.

BACKGROUND OF THE INVENTION

U.S. Pat. No. 3,493,424 (Mohrlok et al.) describes fibrous materials which are given antislip, dulling, and/or dry-soiling resistance properties by applying a colloidal suspension of a silsesquioxane, followed by drying the material.

U.S. Pat. No. 4,351,736 (Steinberger et al.) describes a textile pile-stabilizing impregnating agent comprising a colloidal suspension of silicic acid and organosilsesquioxanes.

U.S. Pat. No. 4,781,844 (Kortmann et al.) describes a textile finishing agent comprising an aqueous colloidal suspension of an organosilsesquioxane-containing sol and an organic polymer resin containing perfluoroalkyl groups which imparts soil resistance.

SUMMARY OF THE INVENTION

This invention describes a novel process for applying an aqueous acidic treatment comprising a silsesquioxane to a fibrous substrate; preferably carpet, to produce fibers that are totally and uniformly treated. Surprisingly, it has been discovered that the anti-soiling and repellent properties of the silsesquioxane compositions are enhanced at low pH. None of the treating compositions and methods described in the art discloses a method for treating a fibrous substrate using an acidic composition comprising a silsesquioxane to simultaneously achieve good antisoiling and good stain resistance properties.

Specifically, this invention relates to a method for imparting repellency and soil resistance to a fibrous substrate comprising the steps of:

(a) contacting the fibrous substrate in a way to cause total wetting with aqueous acidic composition comprising a silsesquioxane (b) treating the fibrous substrate using a combination of a sufficiently high temperature and a sufficient long time to effectively exhaust the treating materials onto the fibrous substrate; and (c) drying the wet treated substrate.

This invention also describes the resulting treated fibrous substrates that exhibit excellent anti-soiling and repellency performance.

The treating process for applying the aqueous acidic composition comprising silsesquioxane can be either an exhaustion process or a topical process. In the exhaustion process, a fibrous substrate is first treated exhaustively by contacting the entirety of each fiber of the substrate with the aqueous composition of this invention. Following the contacting step, the resulting totally wet fibrous substrate is then heated in a water-saturated atmosphere such as a steam box for a time sufficient to affix the treating composition onto each fiber surface. The heated wet fibrous substrate is subsequently rinsed with water and is dried in an oven at sufficient temperature to effectively activate the treating composition on the surface of each fiber. In some cases, application at a sufficient high bath temperature (e.g., over 200° F. (83° C.)) can eliminate the need for the post-steaming operation. The fibrous substrate, having had total penetration throughout each fiber, exhibits significant protection again soiling when compared to untreated carpet as demonstrated by several cycles of "walk-on" tests, and exhibits excellent dynamic water resistance (i.e., the treated carpet resists penetration by water-based drinks spilled from a height).

Examples of suitable exhaustion processes for treating fibrous substrates include immersion, flooding, Beck vat processing, hot otting, padding and puddle foaming application. Useful treating equipment includes equipment available from Eduard Kusters Maschinefabrik GmbH & Co. KG, Krefeld, Germany, such as Kuster's Flex-nip™ equipment, Kuster's foam applicator, Fluicon™ flood applicator and Fluidye™ unit.

Suitable topical treating processes for applying the aqueous acidic composition comprising silsesquioxane include spraying and low density foam application. However, exhaustion treating processes are preferred as they impart superior performance to the treated fibers.

To impart antisoiling resistance to the fibrous substrates, the treating compositions of this invention contain silsesquioxanes. Useful silsesquioxanes include compounds of the formula $RSiO_{3/2}$ where R is an optionally substituted alkyl or aryl of up to 7 carbon atoms, and/or co-condensates of hydrosylates of tetraalkoxysilanes with organotrialkoxysilanes having $RSiO_{3/2}$ or $SiO_2$ units. Useful silsesquioxanes are described in U.S. Pat. Nos. 3,493,424, 4,351,736 and 4,781,844, each incorporated herein by reference. Preferred silsesquioxanes are neutral or anionic silsesquioxanes, prior to addition to the composition.

Suitable fibrous substrates includes carpet, fabric, textiles and any substrate woven from fibers such as yarn or thread; carpet is the preferred form of the fibrous substrate. The fiber can be made from any number of thermoset or thermoplastic polymers, such as polyamide, polyester, acrylic and polyolefin; polyamide (e.g. nylon) is the preferred fiber.

DETAILED DESCRIPTION OF THE PREFERRED EMBODIMENT

The silsesquioxane materials can be any of the types described in U.S. Pat. No. 4,781,844 (Kortmann, et al), U.S. Pat. No. 4,351,736 (Steinberger et al.), U.S. Pat. No. 5,073,442 (Knowlton et al.) or U.S. Pat. No. 3,493,424 (Mohrlok et al.) each of which are incorporated herein by reference. These silsesquioxanes are of the formula R—Si(OR')3 alone or together with silanes of the formula Si(OR')4 wherein R represents a substituted or unsubstituted hydrocarbon radical having 1 to 7 carbon atoms, substituents of which may be halogen atoms and amino, mercapto and epoxy groups, and up to 95% of the R radicals may be methyl groups. R' represents an alkyl radical with 1 to 4 carbon atoms. Preferred silsesquioxanes are those that are neutral or anionic.

The silsesquioxanes may be prepared by adding silanes to a mixture of water, a buffer, a surface active agent and optionally an organic solvent, while agitating the mixture under acidic or basic conditions. It is preferable to add the quantity of silane uniformly and slowly in order to achieve a narrow particle size of 200 to 500 Angstroms. The exact amount of silane which can be added depends on the substituent R and whether an anionic or cationic surface active agent is used.

Copolymers of the silsesquioxanes in which the units can be present in block or random distribution are formed by the simultaneous hydrolysis of the silanes. The preferred amount of silane of the formula $Si(OR')_4$ added is about 2 to 50 percent, relative to the total weight of the silanes employed, prefereably 3 to 20 percent.

The following silanes are useful in preparing the silsesquioxanes of the present invention: methyltrimethoxysilane, methyltriethoxysilane, methyltriisopropoxyoxysilane, ethyltrimethoxysilane, ethyltriethoxysilane, propyltrimethoxysilane, isobutyltrimethoxysilane, isobutyltriethoxysilane, 2-ethylbutyltriethoxysilane, tetraethoxysilane, and 2-ethylbutoxytriethoxysilane.

Generally the composition of this invention comprises from about 0.01 to 1.0 grams of silsesquioxane (0.0025 to 0.25 wt %) dissolved or dispersed in 400 g of water. This composition may be used to exhaustively treat about 100 g of carpet. Preferably the composition comprises from about 0.05 to 0.5 grams of silsesquioxane. The aqueous composition may be rendered acidic by the addition of any inorganic or organic acid, with inorganic acids such as sulfuric being preferred. The acidic aqueous composition preferably has a pH of 4 or less, and more preferably 2 or less.

EXAMPLES

Unless otherwise specified, all percentages shown in the examples and test methods which follow are percentages by weight.

Glossary

SSQO—To a 3-L 3-necked flask equipped with heater, stirrer and condenser was added 1106.0 g of deionized water and 14.0 g of linear alkylsulfonic acid (available from Alfa Aesar Johnson Matthey Ward Hill, Mass.), believed to be dodecylbenzenesulfonic acid). The resulting mixture was heated to 60° C. with stirring until homogeneous, and 280 g of $CH_3Si(OCH_3)_3$ (methyltrimethoxysilane, available from Sigma Aldrich) was slowly added to the mixture over a 4 hour period. The hydrolysis reaction was allowed to continue overnight at 60° C. with stirring, the resulting reaction product was filtered, then sufficient 20% aqueous $NH_4OH$ was added to adjust the pH of the mixture to 7. The neutralized mixture was then stripped using a rotary evaporation at a temperature of 50° C. to produce 530 g of distillate consisting primarily of methanol with a small amount of water. The anionic emulsion of silsesquioxane that had formed was 14% solids and had an average particle diameter of approximately 30 nm, as measured using the Multi Angle Sizing (MAS) option on a Zeta Plus zeta potential analyzer (available from Brookhaven Instruments Corp., Holtsville, N.Y.).

UPBEAT—UPBEAT™ nylon 6 carpet, light cream color, color no. 45101, style 51145, having a face weight of 26 oz/yd$^2$ (0.93 kg/m$^2$), available from Shaw Industries, Dalton, Ga.

T-3—TRANSITION III™ nylon 6,6 carpet, "Blue Moon" color, having a face weight of 36 oz/yd$^2$ (1.2 kg/m$^2$), available from Burlington Industries, Greensboro, N.C.

Test Methods

The following is a description of the test methods referred to in the Examples and specification.

Simulated Flex-Nip Application Procedure—The Simulated Flex-Nip Application Procedure described below was used to simulate the flex-nip operations used by carpet mills to apply stainblocking compositions to carpet.

In this test, a carpet sample measuring approximately 5 inches by 4 inches (13 cm×10 cm), typically weighing approximately 100 g, is immersed in deionized water at room temperature until dripping wet. Water is extracted from the wet sample by spinning in a Bock Centrifugal Extractor (available from Bock Engineered Products, Inc., Toledo, Ohio) until the sample is damp. The damp carpet sample is then steamed for 2 minutes at atmospheric pressure, at a temperature of 90–100° C., and 100% relative humidity in an enclosed steam chamber.

After steaming, the carpet sample is allowed to cool to near room temperature, and the aqueous treating composition is applied by placing the carpet sample, carpet fiber side down, in a glass tray containing the treating composition. The treating composition contains sufficient treating material(s) to give the desired percent solids on fiber (% SOF) and is prepared by dissolving or dispersing the treating materials in deionized water and adjusting the pH of the resulting aqueous treating solution to desired value using 10% aqueous sulfamic acid. The weight of the treating solution present in the glass tray is approximately 4 times the weight of the carpet sample (e.g., 400 g of treating solution for a 100 g carpet sample). The carpet sample absorbs the entire volume of treating solution over a 1 to 2 minute period to give a percent wet pickup of approximately 400%.

Then the wet treated carpet sample is steamed a second time for 2 minutes (using the same conditions and equipment as described above), is immersed briefly in a 5-gallon bucket half full of deionized water, is rinsed thoroughly under a deionized water stream to remove residual, excess treating composition, is spun to dampness using the centrifugal extractor, and is allowed to air-dry overnight at room temperature before testing.

Water Repellency Test—Treated carpet samples were evaluated for water repellency using 3M Water Repellency Test V for Floorcoverings (February 1994), available from Minnesota Mining and Manufacturing Company. In this test, treated carpet samples are challenged to penetrations by blends of deionized water and isopropyl alcohol (IPA). Each blend is assigned a rating number as shown below:

| Water Repellency Rating Number | Water/IPA Blend (% by volume) |
|---|---|
| F | (fails water) |
| 0 | 100% water |
| 1 | 90/10 water/IPA |
| 2 | 80/20 water/IPA |
| 3 | 70/30 water/IPA |
| 4 | 60/40 water/IPA |
| 5 | 50/50 water/IPA |
| 6 | 40/60 water/IPA |
| 7 | 30/70 water/IPA |
| 8 | 20/80 water/IPA |
| 9 | 10/90 water/IPA |
| 10 | 100% IPA |

In running the Water Repellency Test, a treated carpet sample is placed on a flat, horizontal surface and the carpet pile is hand-brushed in the direction giving the greatest lay to the yarn. Five small drops of water or a water/IPA mixture are gently placed at points at least two inches apart on the carpet sample. If, after observing for ten seconds at a 45° angle, four of the five drops are visible as a sphere or a hemisphere, the carpet is deemed to pass the test. The reported water repellency rating corresponds to the highest numbered water or water/IPA mixture for which the treated carpet sample passes the described test.

Dynamic Water Resistance Test—Dynamic water resistance was determined using the following test procedure. A treated carpet sample (15.2 cm×15.2 cm) is inclined at an angle of 45° from horizontal and 20 g of deionized water is impinged onto the center of the carpet sample through a glass tube with 5 mm inside diameter positioned 45.7 cm above the test sample. The increase in weight (g) of the test sample is measured, with lower weight gains indicating better dynamic water repellency properties.

"Walk-On" Soiling Test—The relative soiling potential of each treatment was determined by challenging both treated and untreated (control) carpet samples under defined "walk-on" soiling test conditions and comparing their relative soiling levels. The test is conducted by mounting treated and untreated carpet squares on particle board, placing the samples on the floor of one of two chosen commercial locations, and allowing the samples to be soiled by normal foot traffic. The amount of foot traffic in each of these areas is monitored, and the position of each sample within a given location is changed daily using a pattern designed to minimize the effects of position and orientation upon soiling.

Following a specific soil challenge period, measured in number of cycles where one cycles equals approximately 10,000 foot-traffics, the treated samples are removed and the amount of soil present on a given sample is determined using colorometric measurements, making the assumption that the amount of soil on a given sample is directly proportional to the difference in color between the unsoiled sample and the corresponding sample after soiling. The three CIE L*a*b* color coordinates of the unsoiled and subsequently soiled samples are measured using a 310 CHROMA METER™ color analyzer with a D65 illumination source. The color difference value, ΔE, is calculated using the equation shown below:

$$\Delta E = [(\Delta L^*)^2 + (\Delta a^*)^2 + (\Delta b^*)^2]^{1/2}$$

where:

$\Delta L^* = L^*\text{soiled} - L^*\text{unsoiled}$ $\Delta a^* = a^*\text{soiled} - a^*\text{unsoiled}$ $\Delta b^* = b^*\text{soiled} - b^*\text{unsoiled}$ ΔE values calculated from these colorometric measurements have been shown to be qualitatively in agreement with values from older, visual evaluations such as the soiling evaluation suggested by the AATCC, and have the additional advantages of higher precision, being unaffected by evaluation environment or subjective operator differences. The reported ΔE value for each carpet sample is calculated as an average of between five and seven replicates. The lower the reported ΔE value, the better the soil resistance.

Receding Contact Angle Test—The Receding Contact Angle Test provides a quick and precise prediction of the anti-soiling potential of fluorochemical repellent or hydrocarbon repellent candidates. Using this test procedure, receding contact angle values measured with n-hexadecane have correlated well with anti-soiling values measured from actual foot traffic using the "Walk-On" Soiling Test.

To run this test, the repellent candidate is applied to nylon film as a solution, emulsion, or suspension (typically at about 3% solids) via dip-coating. The nylon film is prepared as follows. Nylon film is cut into 85 mm×13 mm rectangular strips. Each strip is cleaned by dipping into methyl alcohol, wiping with a KIMWIPE™ wipe (commercially available from Kimberly Clark Corp., Boswell, Ga.), taking care not to touch the strip's surface, and allowing the strip to dry for 15 minutes. Then, using a small binder clip to hold one end of the strip, the strip is immersed in the treating solution, and the strip is then withdrawn slowly and smoothly from the solution. The coated film strip is tilted to allow any solution run-off to accumulate at the corner of the strip, and a KIMWIPE™ tissue is touched to the corner to pull away the solution buildup. The coated film strip is allowed to air dry in a protected location for a minimum of 30 minutes and then is cured for 10 minutes at 121° C.

After the coated film strip has dried and cured, a drop of n-hexadecane is applied to the strip and the receding contact angle of the drop of is measured using a CAHN Dynamic Contact Angle Analyzer, Model DCA 322 (a Wilhelmy balance apparatus equipped with a computer for control and data processing, commercially available from ATI, Madison, Wis.). The CAHN Dynamic Contact Angle Analyzer is calibrated using a 500 mg weight. An alligator clip is fastened to a piece of coated film strip about 30 mm long, and the clip and film piece are hung from the stirrup of the balance. A 30 mL glass beaker containing approximately 25 mL of n-hexadecane is placed under the balance stirrup, and the beaker is positioned so that the coated film strip is centered over the beaker and its contents but not touching the walls of the beaker. Using the lever on the left side of the apparatus, the platform supporting the beaker is carefully raised until the surface of n-hexadecane is 2–3 mm from the lower edge of the film strip. The door to the apparatus is closed, the "Configure" option is chosen from the "Initialize" menu of the computer, the "Automatic" option is chosen from the "Experiment" menu, and the computer program then calculates the time for a total of 3 scans. The result should be a time interval of 1 second and estimated total time of 5 minutes, which are the acceptable settings to show the baseline weight of the sample. The Return Key is then pressed to begin the automatic measurement cycle. Ten readings of the baseline are taken before the scan begins. The apparatus then raises and lowers the liquid so that 3 scans are taken. The "Least Squares" option is then selected from the "Analysis" menu, and the average receding contact angle is calculated from the 3 scans of the film sample. The 95% confidence interval for the average of the 3 scans is typically about ±1.2°.

Glass Transition Temperature Measurement—Glass transition temperatures of materials can be measured according to ASTM E 1356-91, "Standard Test Method for Glass Transition Temperatures by Differential Scanning Calorimetry or Differential Thermal Analysis," p. 850.

Examples 1–12 and Comparative Examples C1–C2

In Examples 1–12, using the Simulated Flex-Nip Application Procedure, SSQO silsesquioxane was applied at either 0.1 or 0.3% SOF to either UPBEAT™ nylon 6 carpet or TRANSITION III™ nylon 6,6 carpet. Prior to application, the pH of the treating composition was varied from 7 (as is) or was adjusted to 4 or to 2 by neutralization using 10% aqueous sulfamic acid. The treated carpet was then evaluated for performance using the Water Repellency Test (WR), the Dynamic Water Resistance Test (DWR) (average of two values), and the "Walk-On" Soiling Test (WOS) (one cycle, average of two values).

In Comparative Examples C1 and C2, untreated UPBEAT™ and TRANSITION III™ carpets were evaluated for performance.

Results are presented in TABLE 1.

TABLE 1

| Ex. | % SOF | Carpet | pH | WR (10 point scale) | DWR (g $H_2O$) | WOS (ΔE) |
|---|---|---|---|---|---|---|
| 1 | 0.1 | UPBEAT | 2 | 0 | 8.1 | 1.3 |
| 2 | 0.1 | UPBEAT | 4 | F | 15.3 | 2.8 |
| 3 | 0.1 | UPBEAT | 7 | F | 19.9 | 2.6 |
| 4 | 0.3 | UPBEAT | 2 | 0 | 9.2 | 0.9 |
| 5 | 0.3 | UPBEAT | 4 | F | 19.0 | 3.4 |
| 6 | 0.3 | UPBEAT | 7 | F | 21.3 | 3.3 |
| C1 | untreated | UPBEAT | — | F | 20 | 4.0 |
| 7 | 0.1 | T-3 | 2 | F | 9.1 | 2.9 |
| 8 | 0.1 | T-3 | 4 | F | 21.9 | 5.3 |
| 9 | 0.1 | T-3 | 7 | 0 to F | 17.4 | 5.5 |
| 10 | 0.3 | T-3 | 2 | F | 7.2 | 2.5 |
| 11 | 0.3 | T-3 | 4 | F | 22.8 | 4.9 |
| 12 | 0.3 | T-3 | 7 | F | 24.1 | 4.7 |
| C2 | untreated | T-3 | — | F | 20 | 5.1 |

The data in TABLE 1 show that both UPBEAT™ T-3 and TRANSITION III™ carpets, when treated with the silsesquioxane treating composition, exhibits superior dynamic water resistance and antisoiling performance when the treating composition has a pH of 2 compared to having a pH of either 4 or 7.

Examples 13–16 and Comparative Examples C3–C7

In Examples 13–16, using the Simulated Flex-Nip Application Procedure, SSQO anionic silsesquioxane was applied at either 0.1 or 0.3% SOF to T3 nylon. Prior to application, the pH of the treating composition was adjusted to 4 or to 2 by neutralizing with 10% aqueous sulfamic acid. The treated carpet was then evaluated for performance using the Water Repellency Test (WR) and the "Walk-On" Soiling Test (WOS) (one cycle, average of two values).

In Comparative Examples C3–C6, the same application and testing procedures were used as in Examples 13–16, except that BAYPROTECT™ AS cationic silsesquioxane was substituted for SSQO anionic silsesquioxane.

In Comparative Examples C7, untreated T3 carpet was evaluated for performance.

Results are presented in TABLE 2.

TABLE 2

| Ex. | Silsesquioxane | % SOF | pH | WR (10 point scale) | WOS (ΔE) |
|---|---|---|---|---|---|
| 13 | SSQO | 0.1 | 2 | F | 3.0 |
| 14 | SSQO | 0.1 | 4 | F | 5.0 |
| 15 | SSQO | 0.3 | 2 | 0 | 1.6 |
| 16 | SSQO | 0.3 | 4 | F | 5.2 |

TABLE 2-continued

| Ex. | Silsesquioxane | % SOF | pH | WR (10 point scale) | WOS (ΔE) |
|---|---|---|---|---|---|
| C3 | BAYPROTECT ™ AS | 0.1 | 2 | F | 3.6 |
| C4 | BAYPROTECT ™ AS | 0.1 | 4 | F | 2.3 |
| C5 | BAYPROTECT ™ AS | 0.3 | 2 | F | 3.5 |
| C6 | BAYPROTECT ™ AS | 0.3 | 4 | 0 | 1.2 |
| C7 | — | — | — | F | 6.1 |

The data in TABLE 2 show that, at the lower pH (2), the anionic silsesquioxane provides superior performance to the cationic silsesquioxane.

What is claimed is:

1. A method for treating a fibrous substrate, comprising the steps of:

providing a fibrous substrate;

applying to the substrate an acidic aqueous composition consisting essentially of a silsesquioxane, wherein the composition has a pH less than or equal to 4.

2. The method of claim 1, wherein the composition had a pH less than or equal to 2.

3. The method of claim 1, wherein said silsesquioxane comprise compounds of the formula $RSiO_{3/2}$ where R is a substituted or unsubstituted alkyl or aryl of up to 7 carbon atoms.

4. The method of claim 1, wherein said silsesquioxane comprise cocondensates of hydrosylates of tetraalkoxysilanes with organotrialkoxysilanes, said cocondensate having $RSiO_{3/2}$ or $SiO_2$ units.

5. The method of claim 1, wherein the composition is applied by means of a flex nip process.

6. The method of claim 1, further comprising the step of exposing the substrate to steam after it is treated with the composition.

7. The method of claim 1, wherein the substrate is a carpet.

8. The method of claim 7, wherein the carpet comprises nylon.

9. The method of claim 1, wherein said composition comprises 0.0025 to 0.25 wt. % silsesquioxane.

10. The method of claim 1, wherein said composition is a solution or dispersion.

11. The method of claim 4, wherein said silsesquioxane comprises cocondensates of silanes of the formula $R—Si(OR')_3$, with silanes of the formula $Si(OR')_4$ wherein R represents a substituted or unsubstituted hydrocarbon radical having 1 to 7 carbon atoms, and R' represents an alkyl radical with 1 to 4 carbons atoms.

12. The method of claim 11, wherein silanes of the formula $Si(OR')_4$ comprises 2 to 50 weight percent of the total weight of silane cocondensates.

13. The method of claim 10, wherein said dispersion has a particle size of 200 to 500 Angstroms.

* * * * *

UNITED STATES PATENT AND TRADEMARK OFFICE

CERTIFICATE OF CORRECTION

PATENT NO. : 6,468,587 B2
DATED : October 22, 2002
INVENTOR(S) : Chang, John C.

It is certified that error appears in the above-identified patent and that said Letters Patent is hereby corrected as shown below:

Column 7,
Line 28, insert -- as -- before "compared".

Column 8,
Line 24, delete "had" and insert in place thereof -- has --.
Line 52, delete "carbons" and insert in place thereof -- carbon --.
Line 54, delete "comprises" and insert in place thereof -- comprise --.

Signed and Sealed this

Fifth Day of April, 2005

JON W. DUDAS
*Director of the United States Patent and Trademark Office*